US005129347A

United States Patent [19]

Hill

[11] Patent Number: 5,129,347

[45] Date of Patent: Jul. 14, 1992

[54] MODULAR FLOATING PLATFORMS

[75] Inventor: Anthony E. Hill, Loughborough, United Kingdom

[73] Assignee: Anthony Hill Designs Limited, Loughborough, United Kingdom

[21] Appl. No.: 639,524

[22] Filed: Jan. 10, 1991

[30] Foreign Application Priority Data

Mar. 24, 1990 [GB] United Kingdom ..... 9006629

[51] Int. Cl.[5] ..... B63B 35/44

[52] U.S. Cl. ..... 114/266

[58] Field of Search ..... 114/264, 266, 267, 269; 441/129

[56] References Cited

U.S. PATENT DOCUMENTS 2,518,091 8/1950 Stopkevyc ..... 114/266

FOREIGN PATENT DOCUMENTS 3726871 11/1988 Fed. Rep. of Germany ..... 441/129

*Primary Examiner*—Jesus D. Sotelo

*Attorney, Agent, or Firm*—Mason, Kolehmainen, Rathburn & Wyss

[57] ABSTRACT

A floating platform is assembled from a number of square or rectangular modules. In the corner edges of the modules are slots adapted to receive link plates. Keys lock the plates to the modules by passing through bores in the modules and holes in the plates. The holes in the plates are shaped so that rotation of a key within a hole towards a locking position cams the plate further into its slot. Recesses are provided in walls of the modules to prevent water from spurting onto the surface of the platform when the modules are brought into abutment. Apparatus is provided around the edge of the platform for attaching posts and hinged ramps.

14 Claims, 4 Drawing Sheets

MODULAR FLOATING PLATFORMS

DESCRIPTION

Technical Field

The invention relates to platforms adapted to float on water, and in particular it relates to such platforms suitable for temporary use in a swimming pool for supporting a display or sports or social event.

The Invention

The invention provides a platform for floating on water, or a kit of parts for assembly into such a platform, comprising a number of square or rectangular modules, each module having slots in its corner edges, a number of link plates receivable in the slots, and keys for locking the plates into the modules to make up the platform.

In a preferred embodiment of the invention, a key passes through a hole in a module and a hole in a link plate to lock the plate into the module, the hole in the link plate being shaped so that rotation of the key within the hole towards a locking position cams the link plate further into its slot.

The invention also provides a module having side walls with recesses, to prevent water spurting onto the surface of the platform so that it may remain dry in use. Because the platform's surface may remain dry with careful handling, a carpet panel may be rebated into the surface of a module.

Although the preferred embodiment of the invention is constructed predominantly of wood with a foam core, other materials may be used such as aluminium or frame extrusion plastics with self skinned plastics or granules in the core.

The resulting temporary platform is capable of simple assembly by one person, without their needing to get wet. It is easy to transport, compact to store and adaptable to a variety of different uses in the same pool and to pools of varying shapes.

Drawings

Best Mode

Figure 1:
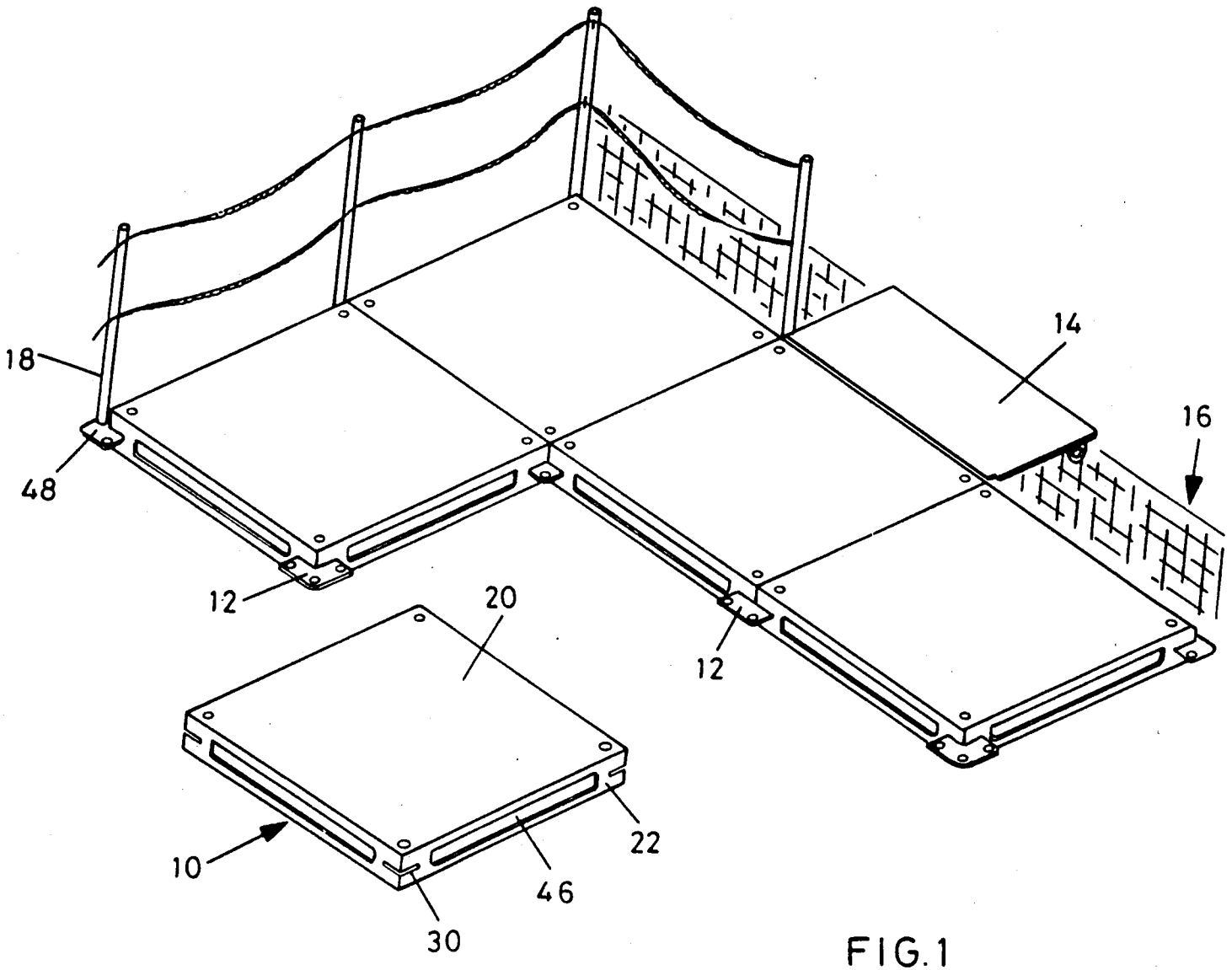
FIG. 1 is a perspective view of a partially assembled floating platform according to the invention, together with an individual module not yet in position.

FIG. 1 shows a platform comprising a number of flat, square, buoyant modules 10 connected to one another at their corners by link plates 12. A ramp 14 connects the platform with the poolside 16 and around the edge of the platform are supported posts 18 for safety ropes.

Figure 3:
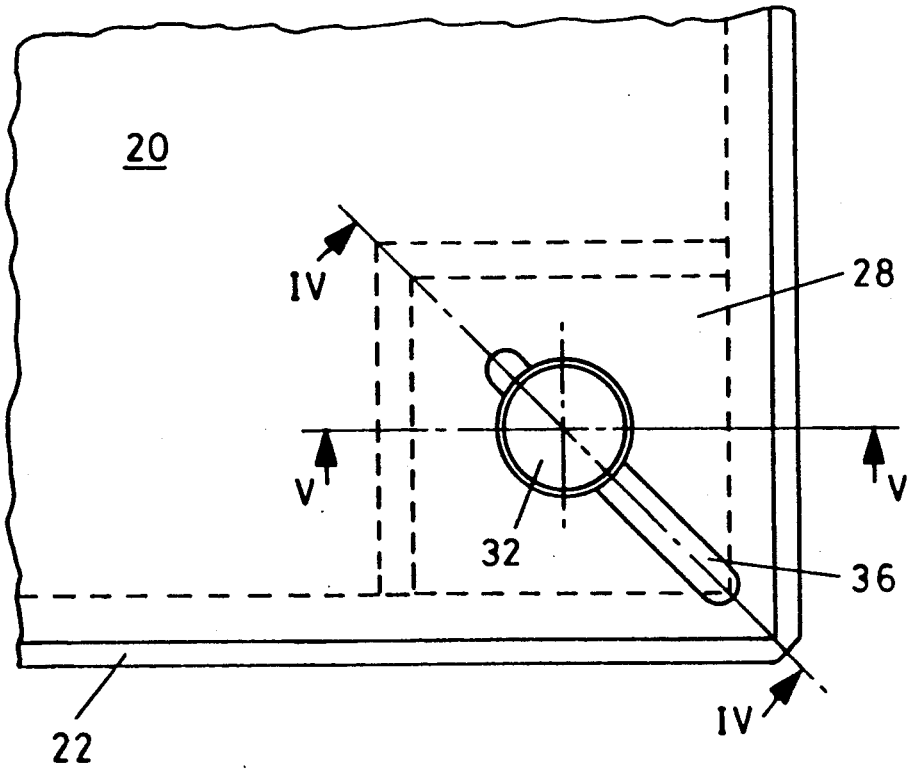
FIG. 3 is a plan view of one corner of a module showing more detail than FIG. 1.
Figure 4:
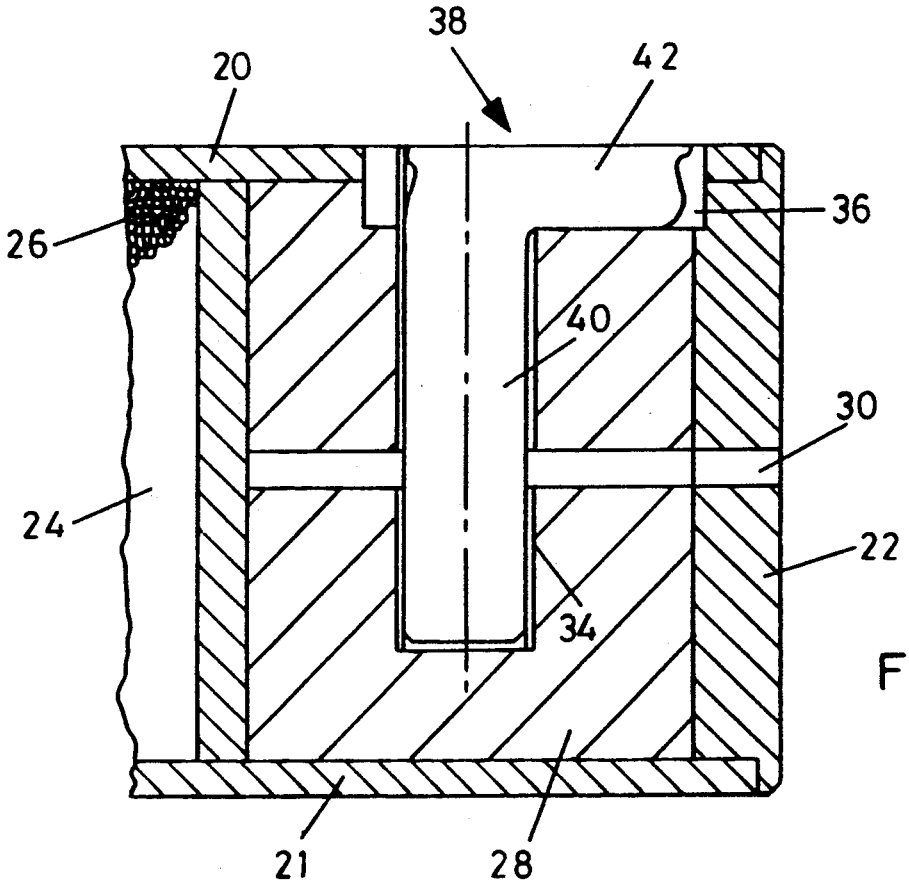
FIG. 4 is a section on a line IV—IV of FIG. 3, showing a key in position.
Figure 5:
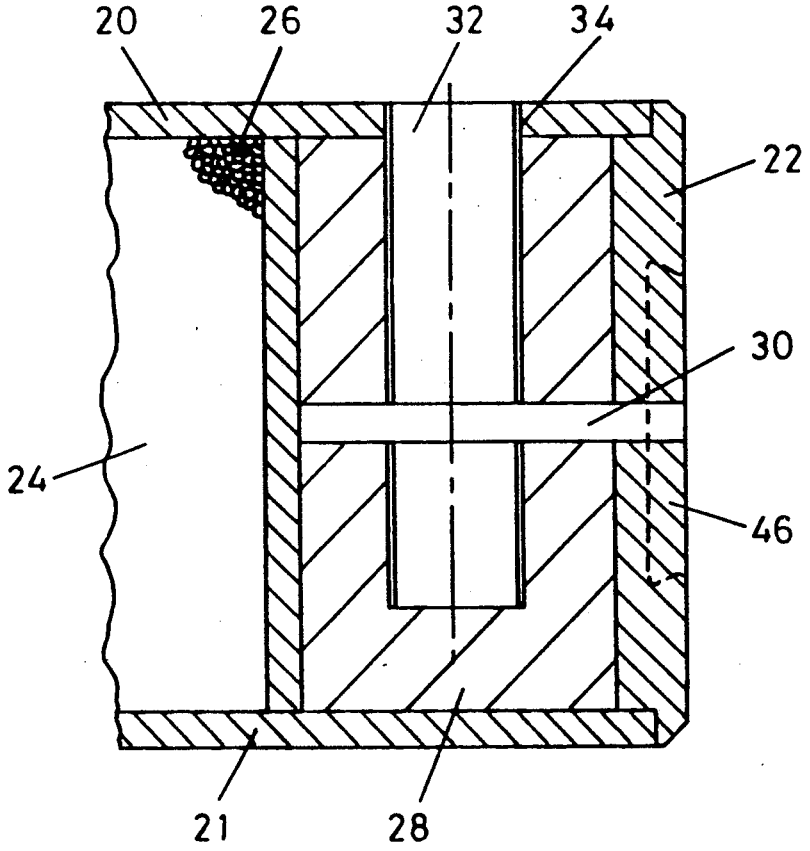
FIG. 5 is a section on a line V—V of FIG. 3.

Each module is constructed from a pair of parallel, square panels 20 and 21, of marine plywood. The gap between the panels is sealed around its edge by a wall 22 of mahogany. The cavity 24 thus formed within the module is filled with a closed cell polystyrene foam 26 chosen to make the module buoyant. In each of the four forners of the cavity 24 is set a block 28, illustrated in FIGS. 3, 4 and 5. Each block is divided by a planar connecting slot 30 midway between the two panels 20 and 21, such that when the corners of four modules meet, their respective connecting slots 30 form a cavity sized and shaped to receive one of the link plates 12. The link plates 12 are typically 8 mm thick, to fit snugly into slots 30 that are 10 mm wide.

At each corner of the module, a cylindrical bore 32 extends perpendicularly through the upper panel 20 and approxiamtely three quarters of the way through the block 28. The walls of the bore 32 are reinforced by a brass tube 34, except where the bore is intersected by the slot 30. A key slot 36 is cut through the upper panel 20 and the upper part of the block 28 in a plane perpendicular to the panel 20, intersecting the bore 32 and extending towards the corner of the module.

An L-shaped key 38 cut from a flat sheet of plastics material has a straight blade 40 which fits into the bore 32, and a head 42 which fits into the key slot 36.

Figure 2:
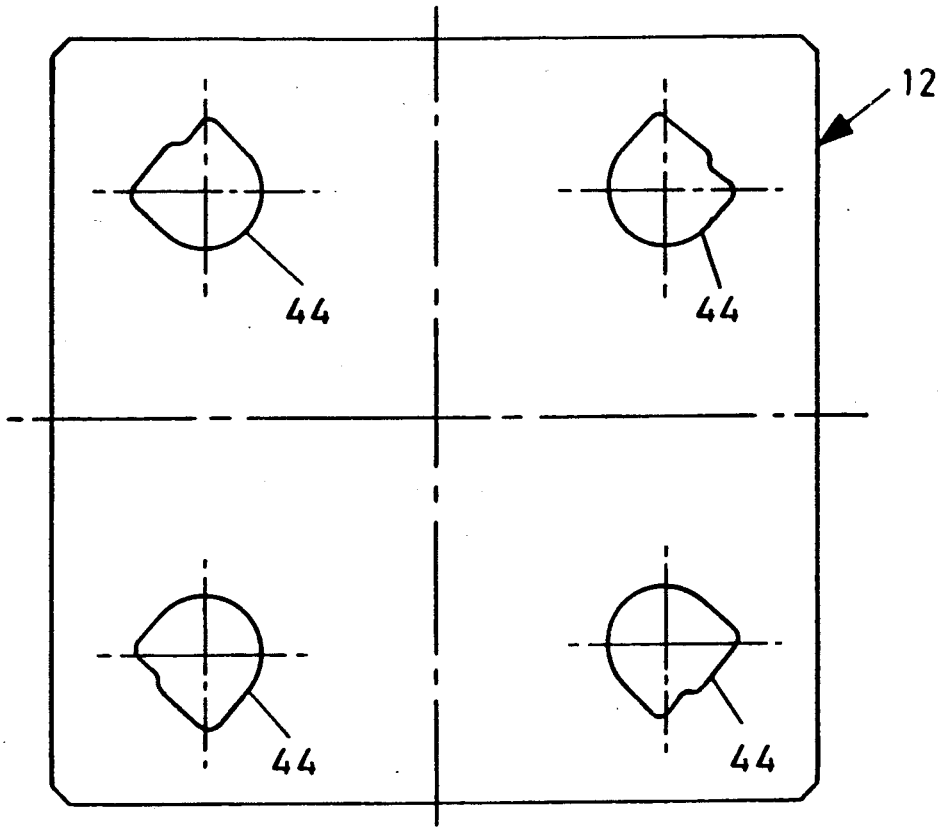
FIG. 2 is a plan view of a link plate used in FIG. 1.

The link plate 12, illustrated in FIG. 2, is a square sheet of acetal plastics material, with a keyhole 44 located near each corner of the plate 12 in such a position that when the corner of the plate is inserted fully into the connecting slot 30 of a module 10, the keyhole 44 is aligned with the bore 32 of the module. A plurality of modules 10 may be assembled simply by one person without the need for that person to enter the water of the swimming pool. For this reason, the modules are of a size and weight that one person can easily carry.

First, at the side of the pool, link plates 12 are fitted into the connecting slots 30 of two adjacent corners of a module 10. Each plate 12 is pushed into its slot 30 until the blade 40 of a key 38 located in the bore 32 and oriented with one flat side facing towards the corner will drop through the keyhole 44. Each keyhole 44 is shaped so that this will be possible even when the plate 12 is not pushed fully into the slot 30. However, rotation of the key 38 within the bore 32 until its head 42 aligns with the key slot 36, brings about a cam effect between the blade 40 and the appropriately shaped keyhole 44 to pull the link plate 12 fully into the connecting slot 30. Then the key head 42 may be pushed down into the key slot 36 so that it does not protrude above the surface of the panel 20, thereby preventing rotation of the key 38 which could loosen the link plate 12 within the slot 30.

Once two link plates 12 are fitted in this way, a second module 10 may be brought alongside the first so that the two link plates engage in connecting slots 30 of the second module. Then keys 38 are inserted into the appropriate bores 32 of the second module to pass through the keyholes 44. The action of turning the keys as described above cams the link plates 12 fully into slots 30, thereby pulling the two modules 10 into abutment and holding them rigidly so, once the keys 38 are pushed home into their respective key slots 36.

With the introduction of a third link plate 12, a third module 10 can be added to the assembly in the same manner as the second. At this stage, with three modules assembled, the platform is sufficiently stable when afloat to support the person assembling it, and so it may be slid onto the water's surface for ease of manoeuvring the modules. Thereafter assembly continues in the same manner, adding link plates 12 and modules 10 as necessary for the desired arrangement.

Each side wall 22 of the modules 10 is provided with a recess 46 extending along most of the length not occupied by connecting slots 30. The purpose of the recesses 46 is to trap water which might otherwise spurt upwards as the modules were brought together if the walls 22 were flat, wetting the person assembling the platform and also its upper surface. The recesses 46 have the further advantage of providing handholds for easier handling of the modules 10, particularly when they are slippery on removal from the water during disassembly.

Since the link plates on the outer edges of the platform are only needed to connect two modules together rather than four, and those on the outer corners engage only a single module, there is no need for them to have the same design as the link plate 12 illustrated in FIG. 2, with four identical keyholes 44. Thus an edge plate 48 may have keyholes 44 in only two adjacent corners. The other two corners may have holes 52 for attaching a ramp 14 with, between them, a hole 54 for mounting a post 18 for a safety rope. A corner plate (not illustrated) having a keyhole 44 in one corner, may have a hole 54 for a handrail 18 in the diagonally opposite corner and holes 52 for a ramp 14 in the remaining two corners. Such edge and corner plates could easily be adapted for other applications of the platform.

Figure 6:
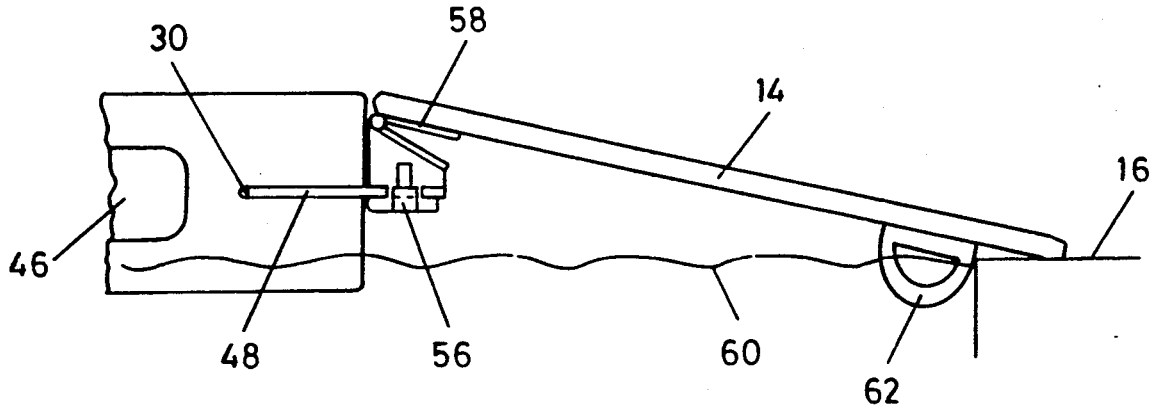
FIG. 6 is an elevation of a ramp in position between a floating platform as in FIG. 1 and a poolside.
Figure 7:
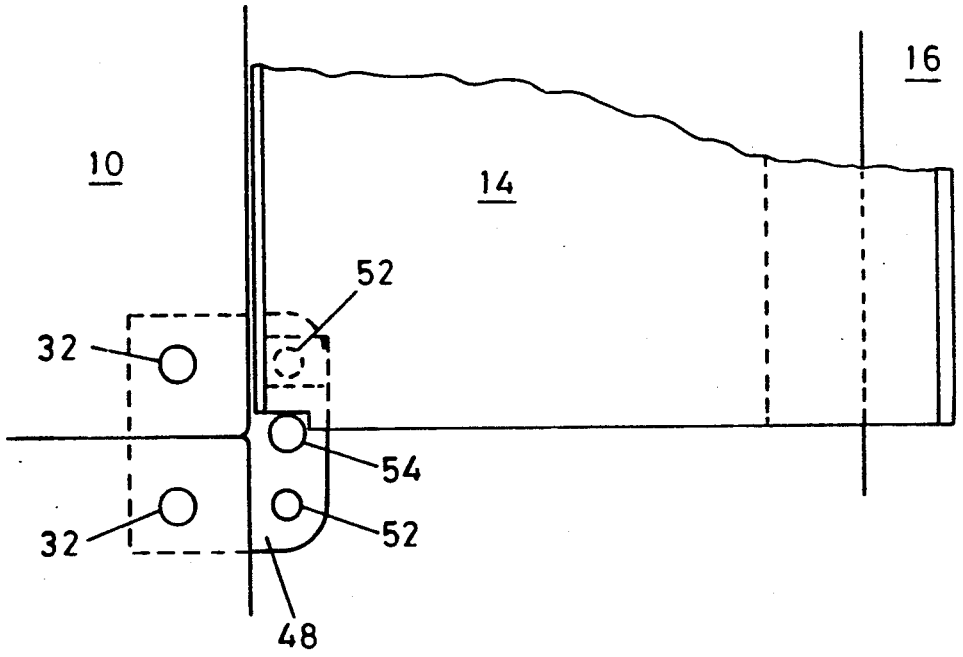
FIG. 7 is a plan of part of the ramp of FIG. 6.

A ramp 14 connecting the floating platform with the poolside 16 is illustrated in FIGS. 6 and 7. It is attached to a single module 10 by means of fasteners 56 through holes 52 in edge plates 48, though several such ramps could be attached to adjacent modules 10 to provide a wider access to the platform. The ramp 14 is provided with a hinge 58 to accomodate vertical movement of the platform in the water and to allow for pool sides 16 that are at different heights above the water's surface 60. The ramp 14 engages the poolside 16 with a rubber fender 62.

To prevent lateral drift of the platform across the water's surface, which could make it inaccessible from the poolside 16 or could damage the poolside because of the great torque of a moving platform about the point of contact between a ramp 14 and the poolside, it is desirable to anchor the platform to the pool in some manner. Many modern pools have a suitable strong anchor point built in but for pools without such a facility a heavy weight resting on the bottom of the pool and attached to the platform would suffice.

Disassembly of the platform simply involves removing the keys 38 from the bores 32 to release the link plates 12 from their slots 30. The modules 10 may then be floated apart.

I claim:

1. A platform for floating on water, comprising a number of square or rectangular modules, each module having slots in its corner edges, a number of link plates receivable in the slots, and keys for locking the plates into the modules to make up the platform, wherein the modules and the link plates have holes defined therein and wherein one of said keys passes through a hole in one of said modules and a hole in one of said link plates to lock the link plate into a slot in the module, the hole in the link plate being shaped so that rotation of the key within the hole towards a locking position cams the link plate further into its slot.

2. A platform according to claim 1, wherein said modules have side walls with recesses therein.

3. A platform according to claim 1 further comprising link plates for the edge of the platform which have means for attaching a hinged ramp.

4. A platform according to claim 3, wherein the link plates for the edge of the platform have means for supporting posts.

5. A platform for floating on water, comprising a number of square or rectangular modules, each module having slots in its corner edges, a number of link plates receivable in the slots, and keys for locking the plates into the modules to make up the platform, and further comprising link plates for the edge of the platform which have means for attaching a hinged ramp, wherein the modules have side walls with recesses therein.

6. A platform according to claim 5, wherein the link plates for the edge of the platform have means for supporting posts.

7. A platform for floating on water, comprising a number of square or rectangular modules, each module having slots in its corner edges, a number of link plates receivable in the slots, and keys for locking the plates into the modules to make up the platform further, comprising link plates for the edge of the platform which have means for attaching a hinged ramp.

8. A platform according to claim 7, wherein the link plates for the edge of the platform have means for supporting posts.

9. A platform kit having components capable of being assembled into a platform for floating on water, comprising a number of square or rectangular modules, each module having slots in its corner edges, a number of link plates receivable in the slots, and keys for locking the plates into the modules to make up the platform, wherein the modules and the link plates have holes defined therein and wherein one of said keys passes through a hole in one of said modules and a hole in one of said link plates to lock the link plate into a slot in the module, the hole in the link plate being shaped so that rotation of the key within the hole towards a locking position cams the link plate further into its slot.

10. A platform kit according to claim 9, wherein a module has side walls with recesses therein.

11. A platform kit according to claim 9 further comprising link plates for the edge of the platform which have means attaching a hinged ramp.

12. A platform kit according to claim 11, wherein the link plates for the edge of the platform have means for supporting posts.

13. A platform kit having components capable of being assembled into a platform for floating on water, comprising a number of square or rectangular modules, each module having slots in its corner edges, a number of link plates receivable in the slots, and keys for locking the plates into the modules to make up the platform, further comprising link plates for the edge of the platform which have means attaching a hinged ramp.

14. A platform kit according to claim 13, wherein the link plates for the edge of the platform have means for supporting posts.

* * * * *